US005685028A

United States Patent [19]

Miller et al.

[11] Patent Number: 5,685,028

[45] Date of Patent: Nov. 11, 1997

[54] BIDET SPRAYER UNIT AND APPARATUS FOR MOUNTING

[76] Inventors: Celia Miller, 3926 Windswept Dr., Montgomery, Tex. 77356; Guadalupe DeLa Garza, 8400 Broadway #143, Houston, Tex. 77061; Charles R. Miller, 3926 Windswept Dr., Montgomery, Tex. 77356

[21] Appl. No.: 524,605

[22] Filed: Sep. 7, 1995

[51] Int. Cl.[6] ..... A47K 3/22

[52] U.S. Cl. ..... 4/443; 4/448; 604/259

[58] Field of Search ..... 4/420.2, 420.4, 4/443, 448, 567, 568, 570; 604/150, 259

[56] References Cited

U.S. PATENT DOCUMENTS

| | | | |
|---|---|---|---|
| 128,909 | 7/1872 | Rhoads | 604/259 |
| 256,745 | 4/1882 | Schenck | 604/150 |
| 1,732,528 | 10/1929 | O'Rourke, Jr. et al. | 604/259 |
| 1,929,785 | 10/1933 | McLaughlin | 604/259 |
| 2,241,823 | 5/1941 | McFarland et al. | 4/448 X |
| 2,364,491 | 12/1944 | Triadou | 4/420.4 X |
| 3,044,465 | 7/1962 | Anderson et al. | 604/150 X |
| 3,104,664 | 9/1963 | Ladd | 604/150 |
| 3,662,407 | 5/1972 | Colucci | 4/448 X |
| 3,769,977 | 11/1973 | Victory | 604/150 |
| 4,000,742 | 1/1977 | DiGlacomo | 4/448 X |
| 4,130,118 | 12/1978 | McLaughlin | 604/150 X |
| 4,510,630 | 4/1985 | Osgood | 4/443 |
| 4,596,058 | 6/1986 | Nourbakhsh | 4/448 |
| 5,023,961 | 6/1991 | Alonso | 4/448 |
| 5,295,274 | 3/1994 | Daniels et al. | 4/443 |

*Primary Examiner*—Robert M. Fetsuga

*Attorney, Agent, or Firm*—Wendy K. Buskop; Chamberlain, Hrdlicka, et al.

[57] ABSTRACT

There is provided a personal hygiene system comprising a means for conducting personal hygiene and a means for removably holding and mounting the personal hygiene device. The personal hygiene device comprises a nozzle having a removable spray tip at a first end, a flexible hose connected to a connection end of the nozzle and a means for connecting the flexible hose to a source of water. Three primary spray tips are included to accomplish various rinsing operations. Also included is a means to add medicinal or cleansing solutions to the flushing fluids. The means for mounting allows for mounting flush with the surface of a wall.

15 Claims, 3 Drawing Sheets

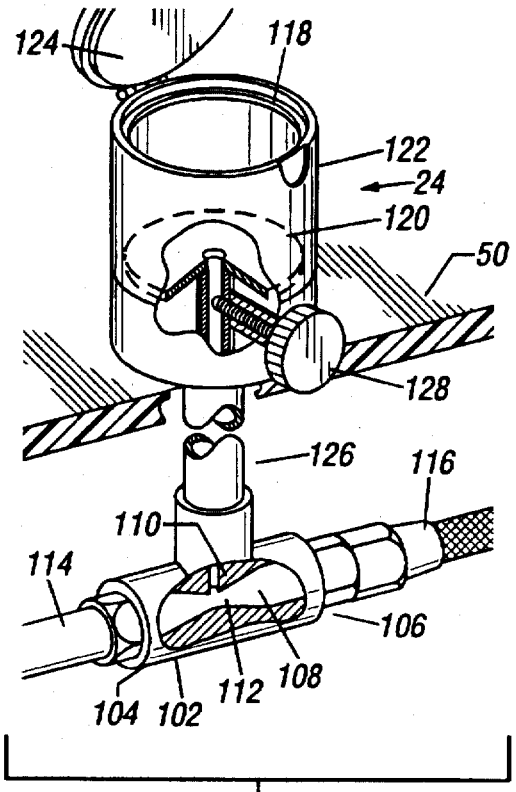
FIG. 2
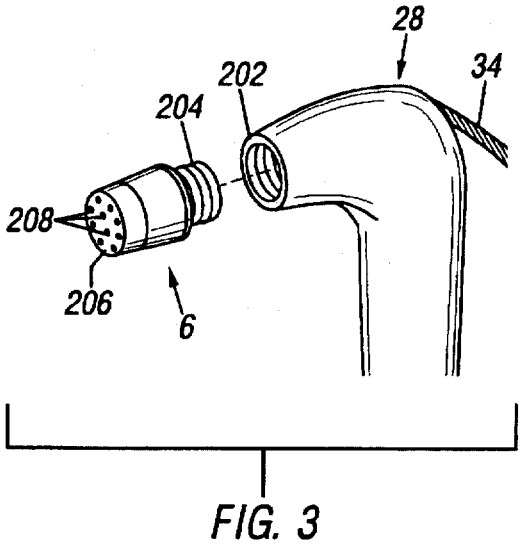
FIG. 3
FIG. 4
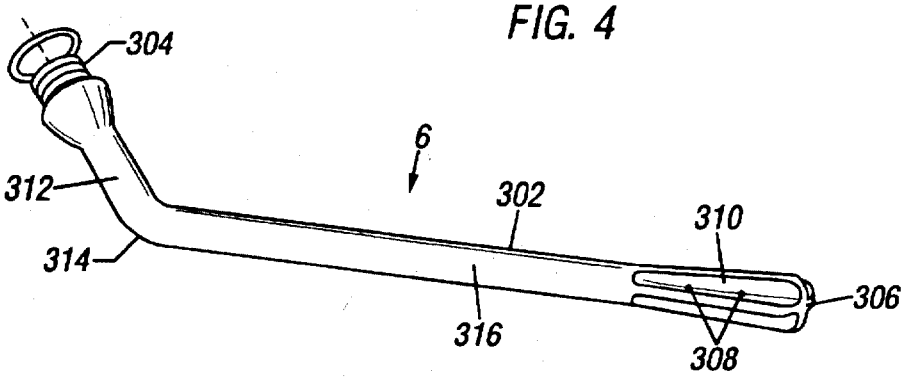

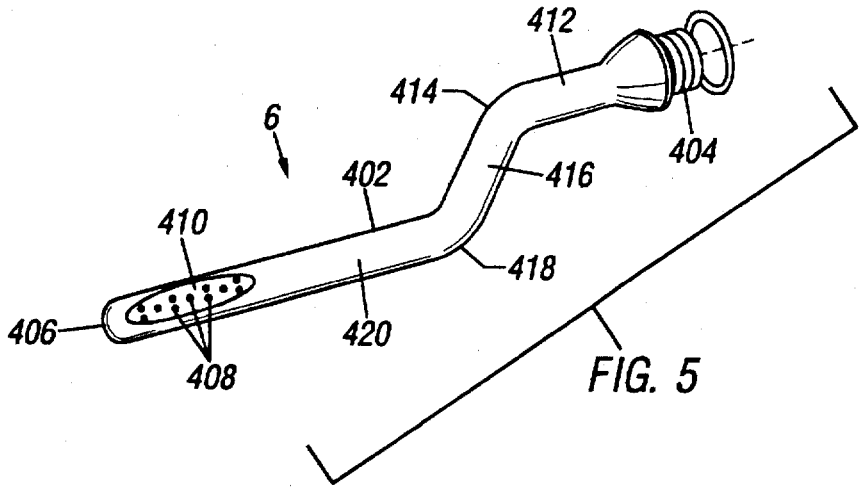
FIG. 5
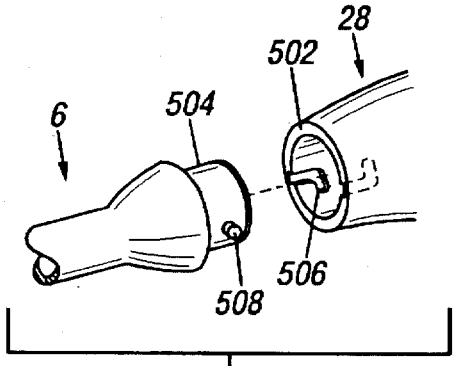
FIG. 6
FIG. 7
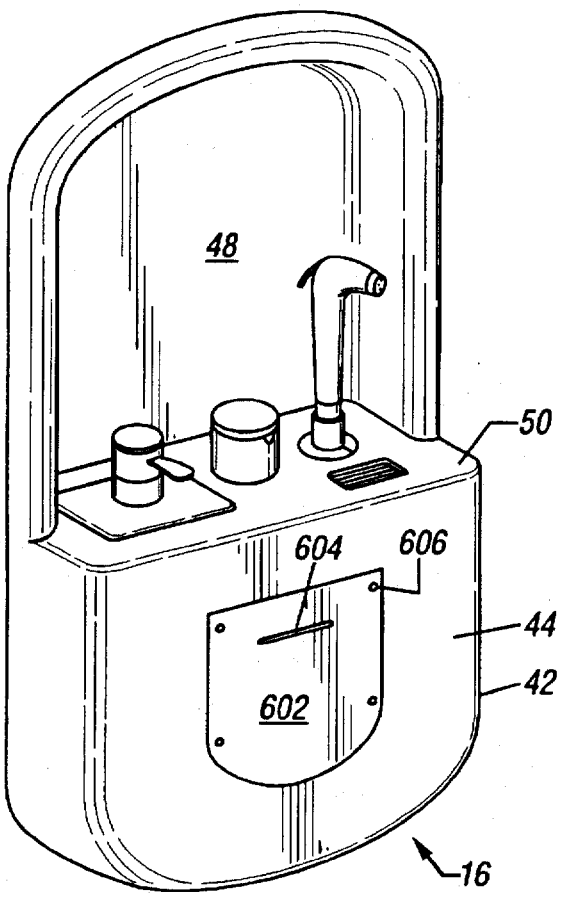

BIDET SPRAYER UNIT AND APPARATUS FOR MOUNTING

BACKGROUND OF THE INVENTION

In one aspect, the invention relates to a bidet device. In another aspect, the invention relates to a housing for a bidet device. Many types of bidet devices are known. However, most devices are large, the size of toilets, and thus cannot be added to an existing structure without extensive remodeling. Portable and mini-bidet devices that have been created have proven to be difficult to install, many times requiring additional plumbing, and/or unsightly once installed. For example, Triadou, U.S. Pat. No. 2,364,491 and Nourbakhsh U.S. Pat. No. 4,596,058 necessitate a partial reconstruction of certain parts of a toilet unit Colucci U.S. Pat. No. 3,662,407 and Daniels et al, U.S. Pat. No. 5,295,274 both require a large amount of plumbing be added for installation. DiGlacomo, U.S. Pat. No. 4,000,742, requires special fittings. A bidet device that is easily installed in existing buildings would be highly desirable.

Many people find that a doctor recommends they either rinse or soak following surgery procedures in the genital and rectal areas, such as after an episiotomy or a hemorrhoidectomy. Further, medicines may need to be added to the rinse or soak water. The usual way to accomplish this is by immersion in a tub. A bidet device that would allow rinsing and medicating of the genital and rectal areas without immersion in a tube would be desirable.

OBJECTS OF THE INVENTION

It is an object of the invention to provide a bidet that does not require extensive plumbing when installed in an existing structure.

It is further an object of the invention to provide an add-on bathroom fixture that is attractive when installed.

It is another object of the invention to provide a bidet device that does not require a second commode or basin be installed.

It is yet another object of the invention to provide a bidet device that can be easily mounted in a wall and a means for so mounting the device.

It is still yet another object of the invention to provide a multi-featured bidet device for rinsing and medicating of the various parts of the genital and rectal areas.

It is yet another object of the invention to provide a bidet device that is easily cleaned and which can be safely used by multiple persons.

SUMMARY OF THE INVENTION

In one embodiment of the invention, there is provided a personal hygiene system comprising a means for conducting personal hygiene and a means for removably holding and mounting the personal hygiene device. The personal hygiene device comprises a nozzle having a removable spray tip at a first end, a flexible hose removably connected to a connection end of the nozzle and a means for connecting the flexible hose to a source of water. Three primary spray tips are included to accomplish various rinsing operations. Also included is a means to add medicinal or cleansing solutions to the flushing fluids.

In another embodiment of the invention, there is provided an apparatus for mounting a personal hygiene system which comprises a holding chamber for concealing plumbing, having a front plate and a top surface, a recessed wall plate substantially parallel to, above and offset from the front plate of the holding chamber, a means for retractably holding a flexible hose positioned within the holding chamber, and a means for conducting personal hygiene. The top surface is positioned substantially normal to the front plate and forms a shelf between and connecting the front plate and the recessed wall plate. A plurality of holes are positioned through the shelf to removably receive the means for conducting personal hygiene on an upper surface of the shelf. A groove is positioned in the shelf substantially to catch drip from the means for conducting personal hygiene. The mounting apparatus is recessed into a wall such that the front plate of the holding chamber is substantially flush with the wall and the recessed wall plate is displaced within the wall. The means for conducting personal hygiene sits in the recessed area formed by the shelf and the recessed wall plate easily accessible to the user.

BRIEF DESCRIPTION OF THE DRAWINGS

FIG. 2 is a sectional view of the holding tank and venturi body of the invention.

FIG. 3 shows a first spray tip and a threaded means for attachment to the nozzle.

FIG. 4 shows a second spray tip.

FIG. 5 shows a third spray tip.

FIG. 6 shows a second means for attaching the spray tips to the nozzle.

FIG. 7 shows a removable access cover attached to the mounting apparatus.

DETAILED DESCRIPTION OF THE PREFERRED EMBODIMENTS

Figure 1:
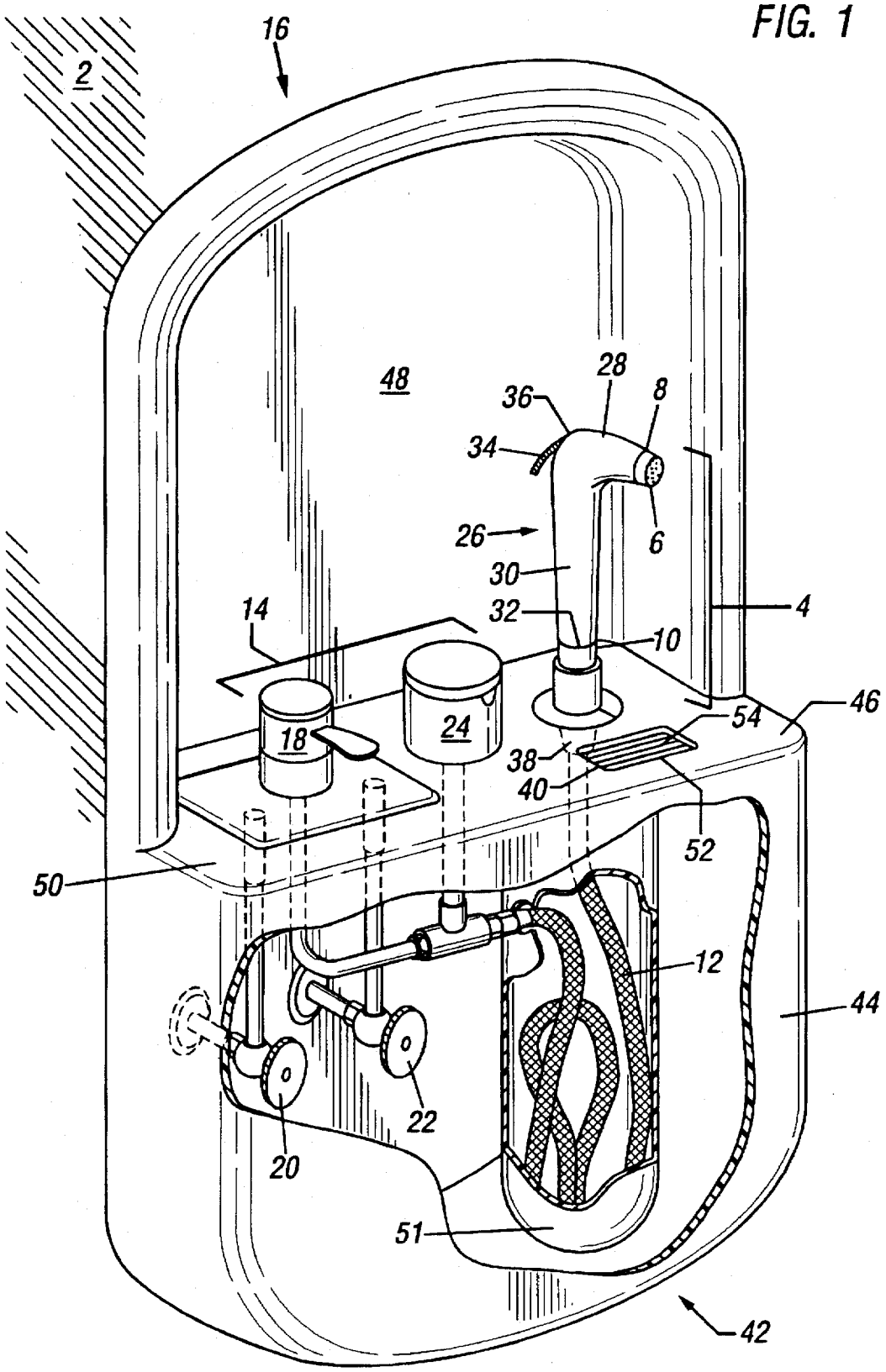
FIG. 1 is a sectional view showing the invention as it would sit in a wall.

Referring to FIG. 1 and FIG. 2, in a first embodiment of the invention, there is provided a personal hygiene system 2 comprising a means for conducting personal hygiene and a means for removably holding and mounting 16 the means for conducting personal hygiene to a wall. The means for conducting personal hygiene comprises a nozzle 4 having a removable spray tip 6 at a first end 8 and a connection end 10, a flexible hose 12 removably connected to the connection end, and a means for connecting the flexible hose to a source of water 14. Several spray tips are provided and are removable so the tips can be easily changed and cleaned by the user. Also, the nozzle is removable from the flexible hose to allow for thorough cleaning and declogging, if necessary. Preferably the means for connecting 14 is a multi-component system comprising a mixing valve 18 for turning on the flow of water to the unit and for mixing hot and cold water to a temperature comfortable for the user, a venturi mixer body 102, a conduit means 114 connecting an inlet end 104 of the venturi 102 with an outlet of the mixing valve, a conduit means 116 connecting an outlet end 106 of the venturi 102 with the flexible hose 12, a hot water source 20 and a cold water source 22. The venturi body 102, which increases fluid pressure to the spray tip, has a venturi passage 108 extending between the inlet 104 and the outlet 106. The venturi mixer body 102 also has an aspirator port 110 extending through a sidewall of the venturi mixer body and opening into a throat 112 of the venturi. Both the hot and cold water sources are connected to the mixer valve 18. The hot water source may be a plumbed hot water line, such as a household hot water line, or it may be a localized hot water heater or heating element. However, the invention will work well when only plumbed to cold water, particularly when the invention is installed in a warmer climate.

In a preferred embodiment, the means for conducting personal hygiene further comprises a means for providing the flushing fluid with a medicinal, cleansing or deodorant additive. Preferably this entails a holding tank 24 which is coupled to a conduit means 126 to allow the holding tank to be easily removed so as to facilitate cleaning. The holding tank 24 has a top opening 118 and a bottom 120. The bottom has a flow hole 122 which allows the medicinal or cleansing additive to pass through. A removable cover 124 is provided to cover the holding tank 24 near the top opening 118. The cover may be attached to the holding tank by any means which provides a seal to keep the holding tank contents from being contaminated by outside debris. Example fittings include a hinged cover, a press-seal cover, or a threaded cover; however, it has been found that complete removability aids in cleaning the holding tank after use. The conduit means 126 forms a flow path between the flow hole 122 of the holding tank and the aspirator port 110 of the venturi mixing body. The conduit means 126 further comprises a metering valve 128 operably associated with the flow path for metering liquid flow from the holding tank 24 to the venturi mixing body 102. The metering valve 128 is hand controlled and is located so as to be easily adjusted by the user, but should be located below the coupling means which couples the holding tank and the conduit means.

For greatest ease of use, the nozzle 4 should have a generally L-shaped handle portion 26. The first short leg 28 of the handle portion is attached to the removable spray tip 6. The second long leg 30, which is between about 6.35 cm (2.5 inches) and 15.24 cm (6.0 inches) in length, is attached to a first end 32 of the connection end 10. A means for controlling flow 34 is best located in the handle portion near an outer bend 36 of the generally L-shape, making it easily accessible while holding the nozzle 4 in the working position. The means for controlling flow is a finger controlled on-off valve which is pressed to turn on the flow and released to stop the flow. The connection end 10 of the nozzle has a second end 38 having external threads which are threadably compatible with a threaded sleeve 40 in the flexible hose 12.

The removable spray tip 6 may be removably attached to the handle portion by several means; however, since the direction of spay may be critical to the function of the spray tip, it is desirable to use an attachment means which produces repeatable alignment. In one embodiment, the first end 202 of the short leg 28 of the handle portion 26 has internal threads and the removable spray tip 6 has external threads on a first end 204, 304, 404, which are threadably compatible with the internal threads of the handle portion 26. In another embodiment, shown in FIG. 6, the first end 502 of the short leg 28 of the handle portion 26 has at least one, substantially S-shaped groove 506 and the first end 504 of the spray tip 6 has at least one retractable prong 508 which is positioned to be removably and slidably received within the at least one substantially S-shaped groove 506.

The removable spray tip may have several shapes, as shown in FIG. 2, FIG. 3 and FIG. 4. One removable spray tip 6 is generally tubular and has a length between about 2.54 cm (1.0 inch) and 8.89 cm (3.50 inches). The longer length prevents the rinse water splashing back onto the hands of the user during use and is believed to be a more comfortable length for larger users. The removable spray tip has a plurality of spray holes 208 positioned in a second end 206 of the spray tip so as to emit fluid substantially parallel to a longitudinal axis of the spray tip. When fully connected to the nozzle, the combined length of the spray tip 6 and the short leg 28 of the handle portion is between about 5.08 cm (2.0 inches) and 12.70 cm (5.0 inches). This type of spray tip is similar to the aspirator head on the average kitchen sink spray attachment; however the angle of the spray is substantially parallel to the longitudinal axis rather than spread in a V-shape fan. The spray tip may be used for genital rinsing or for quick freshening up; for example after intercourse, after urination, during menses, or after childbirth, particularly if the user has had an episiotomy. The spray tip may be made of disposable material, to allow multiple persons to safely use a single bidet.

Another removable spray tip 6, shown in FIG. 4, is generally tubular and has an external surface 302, and internal surface, a first end 304, a closed second end 306, and at least one plurality of spray holes 308 extending from the external surface to the internal surface. The spray tip comprises a first substantially straight portion 312 connected to the first end, a bend portion 314 connected to the first substantially straight portion 312, and a second substantially straight portion 316 which extends between the bend portion and the closed second end 306. The second straight portion 316 is preferably between 10.16 cm (4.0 inches) and 15.24 (6.0 inches) in length and 0.64 cm (0.24 inch) and 1.27 cm (0.50 inch) in diameter. A longitudinal axis of the second substantially straight portion is at an angle between about 120° and 140° from a longitudinal axis of the first substantially straight portion. The at least one plurality of spray holes is oriented parallel to the longitudinal axis of the second substantially straight portion 316. The at least one plurality of spray holes 308 are further positioned near the closed second end 306 and oriented so as to emit fluid normal to the longitudinal axis of the second substantially straight portion 316. When the spray tip 6 and handle portion 26 are fully connected together the longitudinal axis of the first substantially straight portion 312 is coaxial with a longitudinal axis of the short leg 28 of said handle portion, and a plane which contains a longitudinal axis of the long leg 30 of said handle portion and the longitudinal axis of the short leg 28 of said handle portion is generally normal to a plane which contains the longitudinal axes of the short leg 28 of said handle portion, the first substantially straight portion 312 and the second substantially straight portion 316.

The spray tip may also have at least one longitudinally oriented groove 310 which is located in the external surface 302 near the closed second end 306. Each groove present contains a plurality of spray holes located along a longitudinal centerline of the groove. Preferably, the closed second end 306 has a substantially "+" shaped cross-section. A longitudinally oriented groove 310 is positioned within each quadrant of the "+" and each groove 310 contains a plurality of spray holes 308 located along a longitudinal centerline of the groove. This spray tip is suited for douching as the curvature prevents the flushing fluid from running back onto the user's hand. The spray tip may be made of disposable material, to allow multiple persons to safely use a single bidet.

Yet another removable spray tip 6, shown in FIG. 5, is generally a tubular and has an external surface 402, an internal surface, a first end 404, a closed second end 406, a diameter between about 0.64 cm (0.24 inch) and 1.27 cm (0.50 inch), and a length of about 22.86 cm (9.0 inches). The removable spray tip comprises a first substantially straight portion 412 connected to the first end 404, a first bend portion 414 connected to the first substantially straight portion 412, a second bend portion 418 oriented substantially opposite in curvature from the first bend portion 414, a second substantially straight portion 416 extending between the first bend portion 414 and the second bend portion 418, and a third substantially straight portion 420 extending from the second bend portion 418 to the closed second end 406.

Preferably the second substantially straight portion 416 has a length between about 5.08 cm (2.0 inches) and 7.62 (3.0 inches) and a longitudinal axis at an angle between about 120° and 140° from a longitudinal axis of the first substantially straight portion 412. The third substantially straight portion 420 preferably has a length between 10.16 cm (4.0 inches) and 15.24 cm (6.0 inches) and a longitudinal axis substantially parallel to the longitudinal axis of the first substantially straight portion 412. The third substantially straight portion 420 also has at least one plurality of spray holes 408 extending from the external surface 402 to the internal surface. The at least one plurality of spray holes are positioned near the closed second end 406 and extend generally parallel to the longitudinal axis of the third substantially straight portion 420 for a tenth between about 2.54 cm (1.0 inch) and 8.89 cm (3.0 inches). When the spray tip 6 and handle portion 26 are fully connected together the longitudinal axis of the first substantially straight portion 412 is coaxial with a longitudinal axis of the short leg 28 of the handle portion 26. Further, when properly connected, a first plane which contains a longitudinal axis of the long leg 30 of the handle portion 26 and the longitudinal axis of the short leg 28 of the handle portion 26 is generally normal to a second plane which contains the longitudinal axes of the short leg 28 of the handle portion 26, the first substantially straight portion 412, the second substantially straight portion 416 and the third substantially straight portion 420. Most importantly, when properly connected, the plurality of spray holes 408 are positioned so as to emit fluid substantially parallel to the second plane and generally towards the coaxial longitudinal axes of the first end section 412 and the short leg 28 of the handle portion. This spray tip is suited for rectal rinsing, for example after an hemorrhoidectomy or to sooth inflamed tissue in the perianal area. The spray tip may be made of disposable material, to allow multiple persons to safely use a single bidet.

As shown in FIG. 1, the means for removably holding and mounting 16 comprises a holding chamber 42 having a front plate 44 and a top surface 46, and a recessed wall plate 48 substantially parallel to, above and offset from the front plate of the holding chamber. The top surface 46 of the holding chamber 42 is substantially normal to the front plate 44 and the recessed wall plate 48, thus forming a shelf 50 between and connecting the front plate 44 and the recessed wall plate 48. The shelf 50 has a plurality of holes therethrough to removably receive the nozzle 4 and the holding tank 24 and to holdably receive the mixing valve 18 on an upper surface of the shelf. As described previously, the holding tank 24 should be removable for easy cleaning. The nozzle 4 needs to be removable for use. The means for holding and mounting 16 is recessed into a wall near a toilet such that the front plate 44 of the holding chamber is substantially flush with the front surface of the wall and the recessed wall plate 48 is displaced within the wall. Since the unit is mounted near a toilet, the user may use the toiler as a bidet basin. When properly mounted, the shelf 50 is parallel to the floor of the room, essentially forming a horizontal stand for the components of the means for conducting personal hygiene. The holding chamber 42 conceals the plumbing from view. In a preferred embodiment, shown in FIG. 7, the means for holding and mounting also comprises a removable cover 602 positioned to cover an opening in the front plate 44 so as to provide access to the plumbing within the holding chamber. The cover may have a handle 604 for easy removal. The handle may be a depression in the cover, or an attachable handle. The cover 602 may be held to the front plate 44 by several means; it is believed that screws 606 or twist locks will prove effective. The means for holding and mounting 42 is preferably selected from the group consisting of fiberglass, faux marble, acrylic, plastic, and CORIAN® (a registered trademark of DuPont) to blend in well with other bathroom fixtures. The means for holding and mounting may be placed in a bathroom during construction or it may be added to an existing structure.

In a preferred embodiment, the holding chamber 42 contains a means for retractably holding 51 the flexible hose 12. The shelf 50 may have a depression 52 positioned substantially to catch drip from the spray tip 6 of the nozzle 4. If a depression is added, it is preferable if the depression 52 is covered with a grate 54 which is removable.

In another embodiment of the invention there is provided an apparatus for mounting a personal hygiene system. The apparatus comprises a holding chamber 42 having a front plate 44 and a top surface 46 normal to the front plate, a recessed wall plate 48 substantially parallel to and offset from the front plate, a means for retractably holding 51 a flexible hose which is positioned within the holding chamber, and a means for conducting personal hygiene. The top surface 46 of the holding chamber is positioned substantially normal to the front plate 44 so as to form a shelf 50 between and connecting the front plate 44 and the recessed wall plate 48. This shelf 50 has a plurality of holes therethrough to removably receive the means for conducting personal hygiene on an upper surface of the shelf. The shelf may also have a depression 52 positioned substantially to catch drip from the means for conducting personal hygiene. The depression may be covered by a removable grate 54. The mounting apparatus is recessed into a wall such that the front plate of the holding chamber is substantially flush with the front surface of the wall and the recessed wall plate is displaced within the wall. The mounting apparatus is selected from the group consisting of fiberglass, faux marble, acrylic, plastic and ceramic, such as CORIAN®. In a preferred embodiment, the means for holding and mounting also comprises a removable cover 602 positioned to cover an opening in the front plate 44 so as to provide access to the plumbing within the holding chamber. The cover may have a handle 604 for easy removal. The handle may be a depression in the cover, or an attachable handle.

The means for conducting personal hygiene is substantially as already described. In essence it comprises a nozzle 4 having a removable spray tip 6; a connection end 10 and a generally L-shaped handle portion 26 between; a means for controlling flow 34 positioned in the handle portion 26; a flexible hose 12 removably connected to the connection end 10; a mixing valve 18; a venturi mixer body 102 having an inlet end 104, an outlet end 106, a venturi passage 108 extending from the inlet end 104 to the outlet end 106, and an aspirator port 110 extending through a sidewall of the venturi mixer body and opening into a throat 112 of the venturi; a conduit means 114 connecting the inlet end 104 of the venturi 102 with an outlet of the mixing valve; a conduit means 116 connecting the outlet end 106 of the venturi 102 with the flexible hose 12; a water source 20, 22 connected to the mixing valve 18; a holding tank 24 having a top opening 118 and a bottom 120 which has a flow hole 122; a cover 124 removably attached to the holding tank 24 near the top opening 118, the cover 124 positioned to cover the top opening 118; and a conduit means 226 forming a flow path between the flow hole 122 in the bottom of the holding tank and the aspirator port 110 of the venturi mixing body. The conduit means 126 further comprises a metering valve 128 operably associated with the flow path for metering liquid flow from the holding tank 24 to the venturi mixing body 102. Preferably the holding tank 24 is coupled to the conduit means 126 which forms the flow path from holding tank to the venturi to allow for easy cleaning of the holding tank. As already described, the removable spray tip 6 may be attached to the handle portion 26 of the nozzle 4 by a threaded connection or by an S-shaped groove/spring prong connection. The removable spray tips are substantially as already described.

The foregoing provides a description of the preferred embodiments, however, it should be noted that numerous structural changes and modifications may be made without departing from the spirit of the invention.

We claim:

1. A personal hygiene system comprising:

a nozzle having a removable spray tip at a first end and a connection end;

a flexible hose having a first end and a second end with the second end being removably connected to the connection end of the nozzle;

a mixing valve;

a venturi mixer body housing an inlet end and an outlet end, a venturi passage extending from the inlet end to the outlet end, and an aspirator port extending through a sidewall of the venturi mixer body and opening into a throat of the venturi;

a conduit means connecting the inlet end of the venturi with an outlet of the mixing valve;

a conduit means connecting the outlet end of the venturi with the flexible hose;

a hot water source connected to the mixing valve;

a cold water source connected to the mixing valve;

a holding tank having a top opening and a bottom, said bottom having a flow hole;

a cover removably attached to said holding tank near the top opening, said cover positioned to cover said top opening;

a conduit means forming a flow path between the flow hole of said holding tank and the aspirator port of the venturi mixing body;

wherein the conduit means further comprises a metering valve operably associated with the flow path for metering liquid flow from the holding tank to the venturi mixing body;

a holding chamber for concealing plumbing, said holding chamber being defined by a front plate, a recessed wall plate substantially parallel to the front plate, and a top surface which is substantially normal to the front plate and is positioned to form a shelf between the front plate and the recessed wall plate;

wherein said nozzle, said holding tank, and said mixing valve are positioned on an upper surface of said shelf;

with the holding tank being positioned between the nozzle and the mixing valve; and the flexible hose;

the venturi mixer body;

the conduit means connecting the inlet end of the venturi with an outlet of the mixing valve;

the conduit means connecting the outlet end of the venturi with the flexible hose;

the hot water source; and the cold water source;

are positioned in the holding chamber; and the holding chamber is recessed into a wall so that the front plate of the holding chamber is substantially flush with the wall.

2. The personal hygiene system of claim 1 wherein the nozzle further comprises a generally L-shaped handle portion having a first short leg attached to the removable spray tip, a second long leg attached to a first end of the connection end, and a means for controlling flow positioned in the handle portion near an outer bend of said generally L-shape;

the connection end of said nozzle has a second end having external threads threadably compatible with a threaded sleeve in said flexible hose; and the long leg of said handle portion is between about 6.35 cm (2.5 inches) and 15.24 cm (6.0 inches) in length.

3. The personal hygiene system of claim 2 wherein a first end of the short leg of said handle portion has internal threads; and the removable spray tip of said nozzle has a first end, said first end having external threads threadably compatible with the internal threads of said handle portion.

4. The personal hygiene system of claim 2 wherein a first end of the short leg of said handle portion has at least one, substantially S-shaped groove and the first end of the spray tip has at least one retractable prong, said at least one retractable prong positioned to be removably and slidably received within said at least one substantially S-shaped groove.

5. The personal hygiene system of claim 2 wherein the removable spray tip is generally tubular and has a length between about 2.54 cm (1.0 inches) and 8.89 cm (3.50 inches);

the removably spray tip has a plurality of spray holes positioned in a second end of the spray tip so as to emit fluid substantially parallel to a longitudinal axis of the spray tip; and the removable spray tip and the short leg of said handle portion have a combined length between about 5.08 cm (2.0 inches) and 12.70 (5.0 inches) when fully connected together.

6. The personal hygiene system of claim 2 wherein the removable spray tip is generally tubular and has an external surface, an internal surface and a closed second end, and at least one plurality of spray holes extending from said external surface to said internal surface;

the removable spray tip comprises a first substantially straight portion connected to the first end, a first bend portion connected to the first substantially straight portion, and a second substantially straight portion having a length between about 10.16 cm (4.0 inches) and 15.24 cm (6.0 inches) and a diameter between about 0.64 cm (0.24 inch) and 1.27 cm (0.50 inch) extending between said first bend portion and said closed second end;

said at least one plurality of spray holes is oriented parallel to a longitudinal axis of said second substantially straight portion, said plurality of spray holes further positioned near said closed second end so as to emit fluid normal to the longitudinal axis of said second substantially straight portion;

the longitudinal axis of said second substantially straight portion is at an angle between about 120° and 140° from a longitudinal axis of said first substantially straight portion; and when the spray tip and handle portion are fully connected together the longitudinal axis of the first substantially straight portion is coaxial with a longitudinal axis of the short leg of said handle portion, and a plane which contains a longitudinal axis of the long leg of said handle portion and the longitudinal axis of the short leg of said handle portion is generally normal to a plane which contains the longitudinal axes of the short leg of said handle portion, the first substantially straight portion and the second substantially straight portion.

7. The personal hygiene system of claim 6 wherein the spray tip has at least one longitudinally oriented groove located in the external surface near the closed second end, said at least one longitudinally oriented groove containing a plurality of spray holes located along a longitudinal centerline of the groove.

8. The personal hygiene system of claim 7 wherein the closed second end of said spray tip has a substantially "+" shaped cross-section, said grooves positioned within the quadrants of the "+", each groove containing a plurality of spray holes located along a longitudinal centerline of the groove.

9. The personal hygiene system of claim 2 wherein the removable spray tip is generally tubular and has an external surface, an internal surface, a first end, a closed second end, a diameter between about 0.64 cm (0.24 inch) and 1.27 cm (0.50 inch), and a length of about 22.86 cm (9.0 inches);

the removable spray tip comprises a first substantially straight portion connected to the first end, a first bend portion connected to the first substantially straight portion, a second bend portion oriented substantially opposite in curvature from said first bend portion, a second substantially straight portion extending between said first bend portion and said second bend portion, said second substantially straight portion having a length between about 5.08 cm (2.0 inches) and 7.62 (3.0 inches) and a longitudinal axis at an angle between about 120° and 140° from a longitudinal axis of said first substantially straight portion, and a third substantially straight portion extending from said second bend portion to said closed second end, said third substantially straight portion having a length between 10.16 cm (4.0 inches) and 15.24 cm (6.0 inches), a longitudinal axis substantially parallel to the longitudinal axis of said first substantially straight portion, and at least one plurality of spray holes extending from said external surface to said internal surface, said at least one plurality of spray holes positioned near said closed second end and extending generally parallel to the longitudinal axis of said third substantially straight portion for a length between about 2.54 cm (1.0 inch) and 8.89 cm (3.0 inches); and when the spray tip and handle portion are fully connected together the longitudinal axis of the first substantially straight portion is coaxial with a longitudinal axis of the short leg of said handle portion, a first plane which contains a longitudinal axis of the long leg of said handle portion and the longitudinal axes of the short leg of said handle portion is generally normal to a second plane which contains the longitudinal axes of the short leg of said handle portion, the first substantially straight portion, the second substantially straight portion and the third substantially straight portion, and the plurality of spray holes are positioned so as to emit fluid substantially parallel to said second plane and generally towards the coaxial longitudinal axes of said first end section and said short leg of said handle portion.

10. The personal hygiene system of claim 2 wherein the means for controlling flow is a finger controlled on-off valve.

11. The personal hygiene system of claim 10 wherein the holding chamber is formed from a material selected from the group consisting of fiberglass, faux marble, acrylic, plastic and ceramic.

12. The personal hygiene system of claim 10 further comprising a means for retractably holding said flexible hose, said means for retractably holding positioned within said holding chamber.

13. The personal hygiene system of claim 12 wherein the shelf has a depression positioned substantially to catch drip from the spray tip of said nozzle.

14. The personal hygiene system of claim 13 further comprising a grate removably covering the depression in the shelf.

15. The personal hygiene system of claim 14 further comprising a removable cover positioned to cover an opening in the front plate so as to provide access to plumbing within said holding chamber.

* * * * *